US005517704A

United States Patent [19]

Dagostino

[11] Patent Number: 5,517,704

[45] Date of Patent: May 21, 1996

[54] COMBINED COMMODE AND SHOWER CHAIR APPARATUS

[76] Inventor: Richard J. Dagostino, 230 Percival Dr., West Barnstable, Mass. 02668

[21] Appl. No.: 287,261

[22] Filed: Aug. 8, 1994

[51] Int. Cl.[6] ..... A47K 3/12

[52] U.S. Cl. ..... 4/560.1; 4/480; 4/578.1

[58] Field of Search ..... 2/480, 560.1, 578.1

[56] References Cited

U.S. PATENT DOCUMENTS

| | | | |
|---|---|---|---|
| 3,758,894 | 9/1973 | Finley | 4/560.1 X |
| 4,266,305 | 5/1981 | Kavaloski et al. | 4/254 X |
| 4,570,631 | 4/1985 | Grady | 4/480 X |
| 5,373,591 | 12/1994 | Myers | 4/560.1 |

OTHER PUBLICATIONS

Activeaid p. 289, Activeaid Inc, 1989.

*Primary Examiner*—Charles E. Phillips
*Attorney, Agent, or Firm*—Brian M. Dingman

[57] ABSTRACT

A combined commode and shower chair apparatus, comprising: a base section; a seat section adapted to rest on the base section; and an outrigger section removably attachable to the base section. The seat section is slidable from the base section onto the outrigger section for transferring a person in the seat section over a standard bathtub for taking a shower.

10 Claims, 8 Drawing Sheets

COMBINED COMMODE AND SHOWER CHAIR APPARATUS

FIELD OF INVENTION

This invention relates to a combined commode and shower chair apparatus that allows a person that cannot walk or stand complete access to a standard bathroom with minimal assistance.

BACKGROUND OF INVENTION

Physically disabled persons often require assistance in using bathroom facilities such as the toilet and the shower. There is a variety of equipment available to assist with such bathroom needs. One class of such equipment is toilet chairs, which have a padded toilet seat. The chairs can roll over a standard toilet so that the person can use the toilet without having to be moved from the chair. These chairs can also be wheeled into showers which are made wheelchair-accessible. However, as most showers, both in the home and in institutions such as hotels, are not wheelchair accessible, very expensive retrofitting of the shower facilities is required in order to allow a wheelchair to be wheeled into the shower.

There is also apparatus available specifically to assist in the use of shower facilities. Bathtub lifts are expensive to install and have only one use. There are also many different types of transfer benches which have an extension which extends to the edge of, or outside of, a bathtub, so that a person can be seated on the extension and then slid over onto the seat which is in the tub. One example of such an apparatus is the "Tubby II Tub Transfer Chair" available from Activeaid, Inc., Redwood Falls, Minn. Improvements to such transfer chairs are disclosed in U.S. Pat. No. 3,758,894, issued to Mary Finley on Sep. 18, 1973, and U.S. Pat. No. 4,253,203, issued on Mar. 3, 1981, to Morton Thomas. Both patents disclose transfer benches with seats or seat portions which slide along parallel rods to assist in transferring the person from outside of the tub into the tub. Even these solutions, however, require that the person be assisted, or lifted, from the wheelchair onto the transfer bench in order to take the shower, and then lifted back into the wheelchair once the shower has been completed. Accordingly, quite a bit of assistance is still required.

SUMMARY OF INVENTION

It is therefore an object of this invention to provide a combined commode and shower chair.

It is a further object of this invention to provide such a chair which allows a person that cannot walk or stand complete access to a standard bathroom with minimal assistance.

It is a further object of this invention to provide such a chair which is of low cost compared to major bathroom renovations required for removal of bathtubs and installation of wheelchair roll-in showers, or adding chair lifts to the side of the tub to get the person in and out of the tub.

It is a further object of this invention to provide such a chair which requires fewer lifts of the person than with other bathroom access apparatus.

This invention results from the realization that a single chair can provide complete access to both toilet and standard bathtub facilities by including a removable outrigger which can be attached to the chair and which includes tracks along which the seat portion of the chair can be slid. When the outrigger is placed in the tub, with the chair alongside the tub, the person may then simply slide himself in the chair in which he is currently sitting, along the outrigger, until he is over the tub. The person may then slide back out of the tub area when the shower is completed. Upon removal of the outrigger, the chair then effectively becomes a standard commode chair which then can be rolled over a standard toilet.

This invention features a combined commode and shower chair apparatus, comprising: a base section; a seat section adapted to rest on the base section; an outrigger section removably attachable to said base section; and means for sliding said seat section from said base section onto said outrigger section for transferring a person in the seat section over and out of the tub area. The base section may include four spaced vertical base support members, and a wheel coupled to each vertical base support member for allowing the base section to be wheeled about. Further included may be two floor friction brakes for contacting the ground to lift at least two of the wheels off of the ground to stabilize the base section.

The base section may further include four upper cross-members interconnecting the vertical base support members proximate the upper ends thereof in a rectangular pattern, and two lower cross-members, each one interconnecting two different vertical base support members to leave the lower portion of at least one side of the base section open so that it can fit over a commode.

The seat section may include a toilet seat and at least one side arm rest, which may be pivotably attached to the seat section to permit entry and exit from the seat from the side of the seat. The seat section may further include a padded seat back.

The outrigger section may include parallel side support members, a leg member attached proximate one end of each parallel side support member, and means for adjusting the length of each leg member for altering the height of the outrigger section. The outrigger section may further include means for engaging with the base section, which may be accomplished with a plurality of slotted key ways on one of the base section and the outrigger section, and a like plurality of enlarged-head studs on the other of the base section and the outrigger section for fitting into and engaging with the key ways.

The means for sliding the seat section from the base section onto the outrigger section may include track members on the base section and on each side support member of the outrigger section, and rollers on the seat section adapted to engage with the track members. The track members may include a C-shaped track mounted to opposite sides of the base section such that the open parts of the tracks face one another, and the same shaped track mounted along each parallel side support member of the outrigger section such that their open parts face one another, wherein each track on the base section is aligned with a track on the outrigger section when the outrigger section is attached to the base section to allow the seat section to roll on the rollers along the track from the base section onto the outrigger section. The seat section may include two rollers on each of two sides engaged with the track members.

In a more specific embodiment, this invention features a combined commode and shower chair apparatus, comprising: a base section including four leg members with wheels at one end; upper cross-members interconnecting said leg members in a rectangular pattern; and lower cross members interconnecting no more than three said leg members to leave an opening so that said base section can be wheeled over a commode; wheel-receiving track members on the inside and substantially along the length of two parallel upper cross members; a seat section including four seat support members interconnected in a rectangular pattern; a padded seat on top of said four seat support members; at least one side arm rest and a back member, connected to said four seat support members; and at least two wheels on axles fixed to each of two parallel seat support members, said wheels adapted to fit into said wheel-receiving track members on the inside and substantially along the length of said two parallel upper cross members; an outrigger section including two parallel side support members interconnected at one end with a cross member; adjustable-height legs attached proximate said one ends of said parallel side support members; and wheel-receiving track members on the inside and along the length of said two parallel side support members; and a plurality of slotted key ways on one of said outrigger section proximate the other ends of its parallel side support members, and said base section; and a like plurality of enlarged-head studs on the other of said outrigger section proximate the other ends of its parallel side support members, and said base section, said studs fitting into said key ways to hold said outrigger section against said base section such that the track members on said outrigger section and said base section align to allow the wheels of said seat section to roll along the track for moving said seat section to and from said base section and said outrigger section.

BRIEF DESCRIPTION OF THE DRAWINGS

Other objects, features and advantages will occur to those skilled in the art from the following description of a preferred embodiment and the accompanying drawings, in which.

DESCRIPTION OF THE PREFERRED EMBODIMENT

The combined commode and shower chair apparatus of this invention allows a person that cannot walk or stand complete access to a standard bathroom with minimal assistance. The apparatus includes a base section which is adapted to be rolled over a standard toilet, with a seat section adapted to rest on the base section, so that the person can use the toilet facilities. The apparatus also includes an outrigger section which is removably attachable to the base section. The apparatus is adapted so that the seat section can be slid from the base section onto the outrigger section to transfer a person sitting in the seat section over and out of the tub area.

Figure 1:
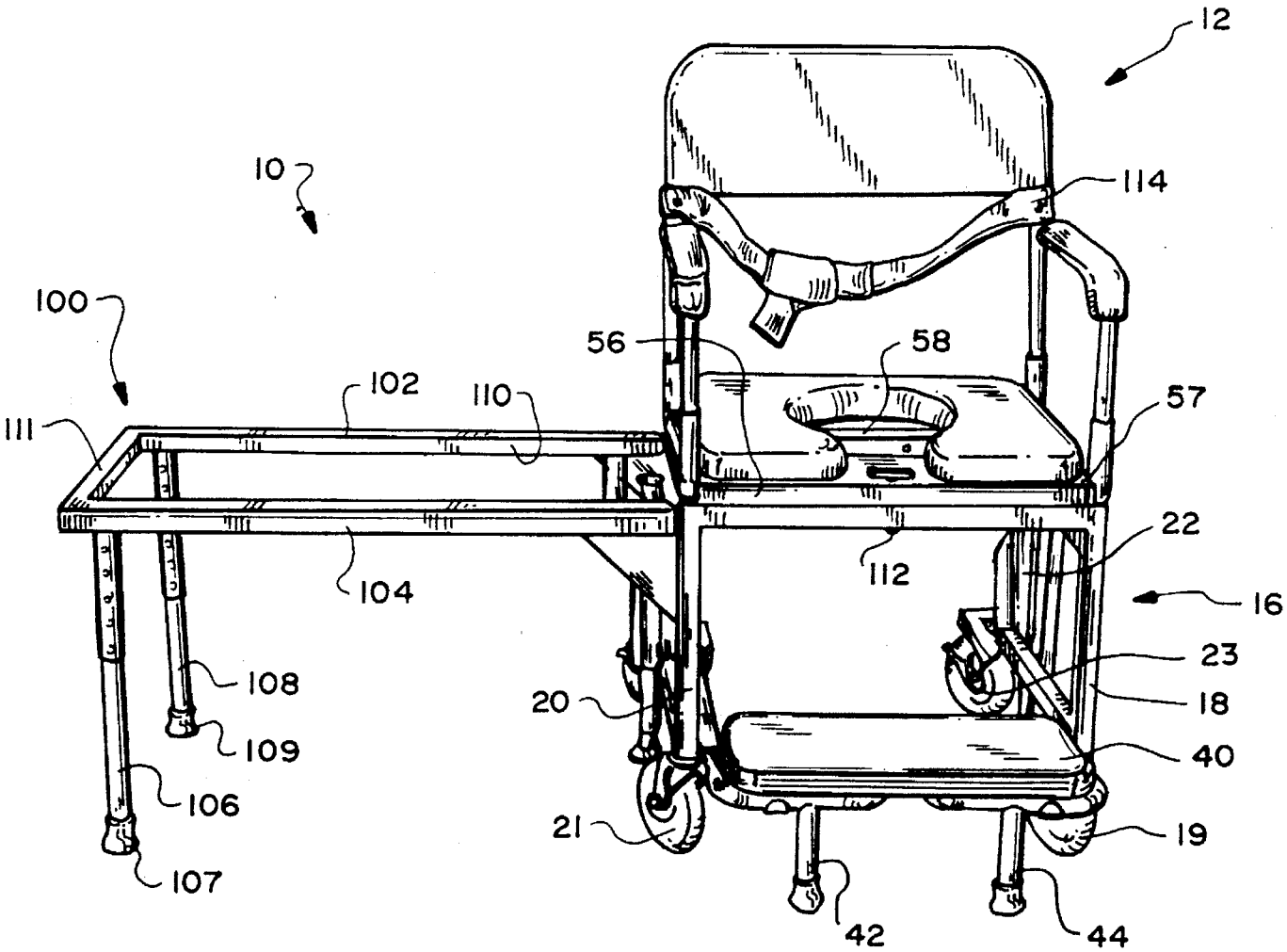
FIG. 1 is an axomometric view of a combined commode and shower chair apparatus according to this invention with the seat in the standard position, in which the apparatus is effectively a commode chair, with the outrigger attached ready to transfer the person into a shower.

There is shown in FIG. 1 combined commode and shower chair apparatus 10 according to this invention. Chair 10 includes base section 16 with seat section 12 adapted to rest thereon. Outrigger section 100 is adapted to be removably attachable to base section 16. Seat section 12 is able to slide from its position on the base section as shown in FIG. 1 onto and to the end of outrigger section 100 as shown in FIGS. 4 and 5.

Figure 3:
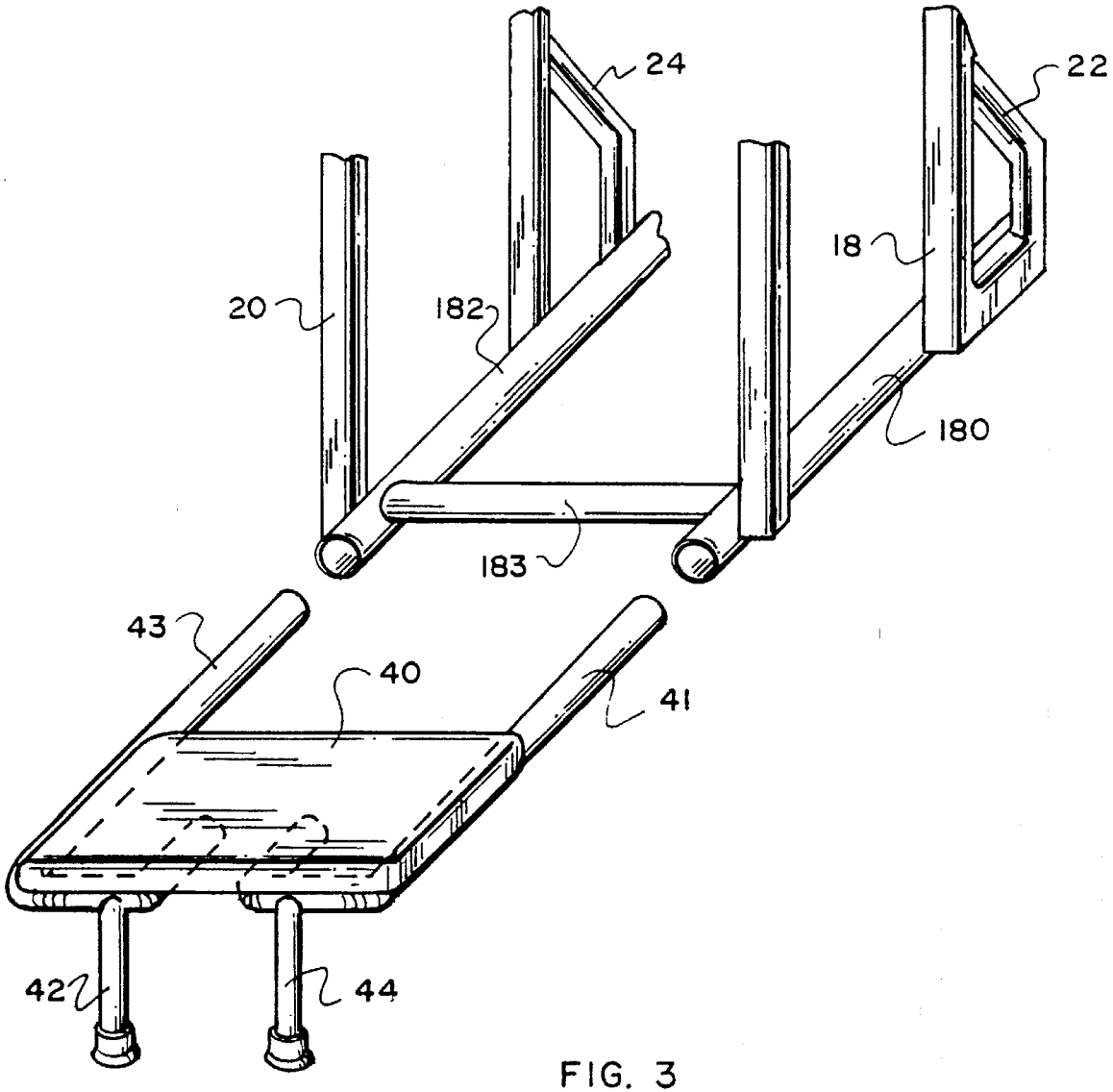
FIG. 3 is a view of the foot rest platform and how it attaches to the base section of the device of FIGS. 1 and 2.

Base section 16 includes four vertical base support members, or legs, 18, 20, 22 and 24. Each leg has a wheel or caster at the lower end, numbers 19, 21, 23 and 25. The two front caster wheels 21 and 19 may have built in friction brakes. Base 16 also includes floor friction brakes 30 and 32 manufactured by Lumex, Inc. Foot rest platform 40, FIG. 3, is attached to members 41 and 43 which are supported by the base section lower cross members 182 and 180, in a telescoping manner, thus allowing the foot rest platform to be slid under the base section 16 for storage, and allowing the foot rest section to be slid out to meet the comfort of the user. Cross member 180 and 182 themselves interconnect vertical base support members 18 and 20, and 22 and 24, respectively. Footrest platform legs 42 and 44 provide stability to the platform, which can be slid out from under the chair as is known in the art of wheelchairs.

Base section 16 also includes upper cross members 52 through 55 which interconnect all of the vertical base support members at or near the upper ends thereof in a rectangular pattern. There is no lower cross member at the back side of the base section so that the base section can be wheeled over a standard toilet.

Figure 4:
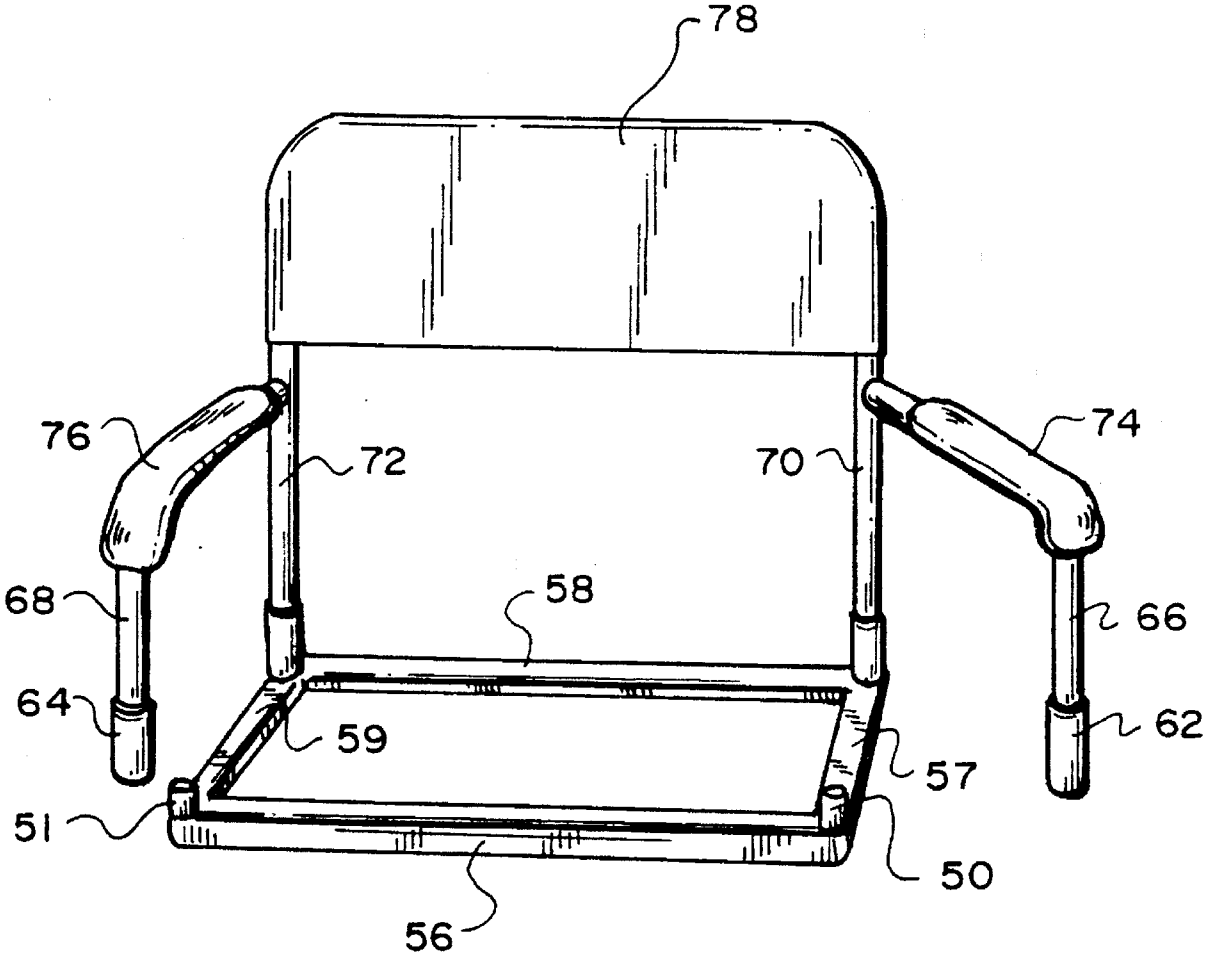
FIG. 4 is a more derailed diagram of the arm rest of the device of FIGS. 1 and 2.

Seat section 12 includes padded toilet seat 60 which is carried on a frame consisting of four horizontal seat base support members 56 through 59, FIG. 4, connected in a rectangular pattern, which rest on base section 16. Side arm rests 74 and 76 are pivotably attached to seat back supports 70 and 72, respectively, which are themselves attached at the lower ends to the seat base support members. The front ends of arm rests 74 and 76 have tubes 66 and 68 protruding therefrom. Attached to the bottom of tubes 66 and 68 are small sliding tubes 62 and 64, respectively, which move up and down over studs 50 and 51 that are attached to the front corners of seat base support member 56. This arrangement allows sliding tube members 62 and 64 to be lifted off of the studs 50 and 51 so that the arm rests can be pivoted out of the way to allow a person to slide onto seat 60 from either side. Seat back 78 is supported by supports 70 and 72. Seat strap 114 is used if a person needs to be strapped into the chair.

Figure 2:
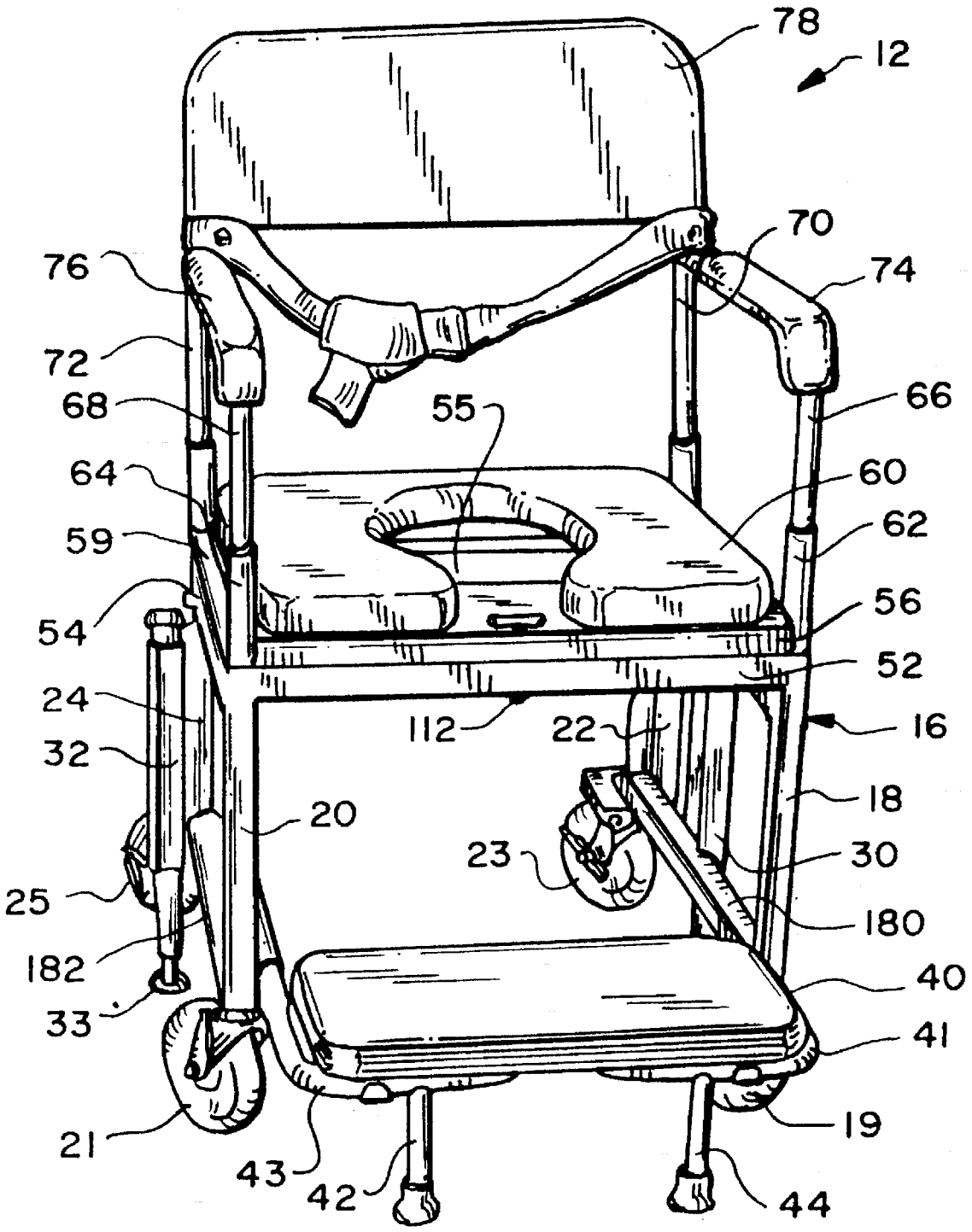
FIG. 2 is a similar view of the apparatus of FIG. 1 with the outrigger removed to show more detail.

Seat section 12 includes at its bottom no less than four wheels, two at the front and two at the back. The wheels fit into a track which is attached to the front and back base section upper cross members 52 and 55, respectively. The arrangement of the track is show in more detail in FIGS. 3A, 4, 5 and 6. These wheels keep seat section 12 from being lifted off of base section 16. Pin 112 is made to fit through holes through seat base support member 56 and base section upper cross member 52 so that seat section 12 can be fixed in place on base section 16 when the apparatus is used as a commode chair as shown in FIG. 2.

Figure 5A:
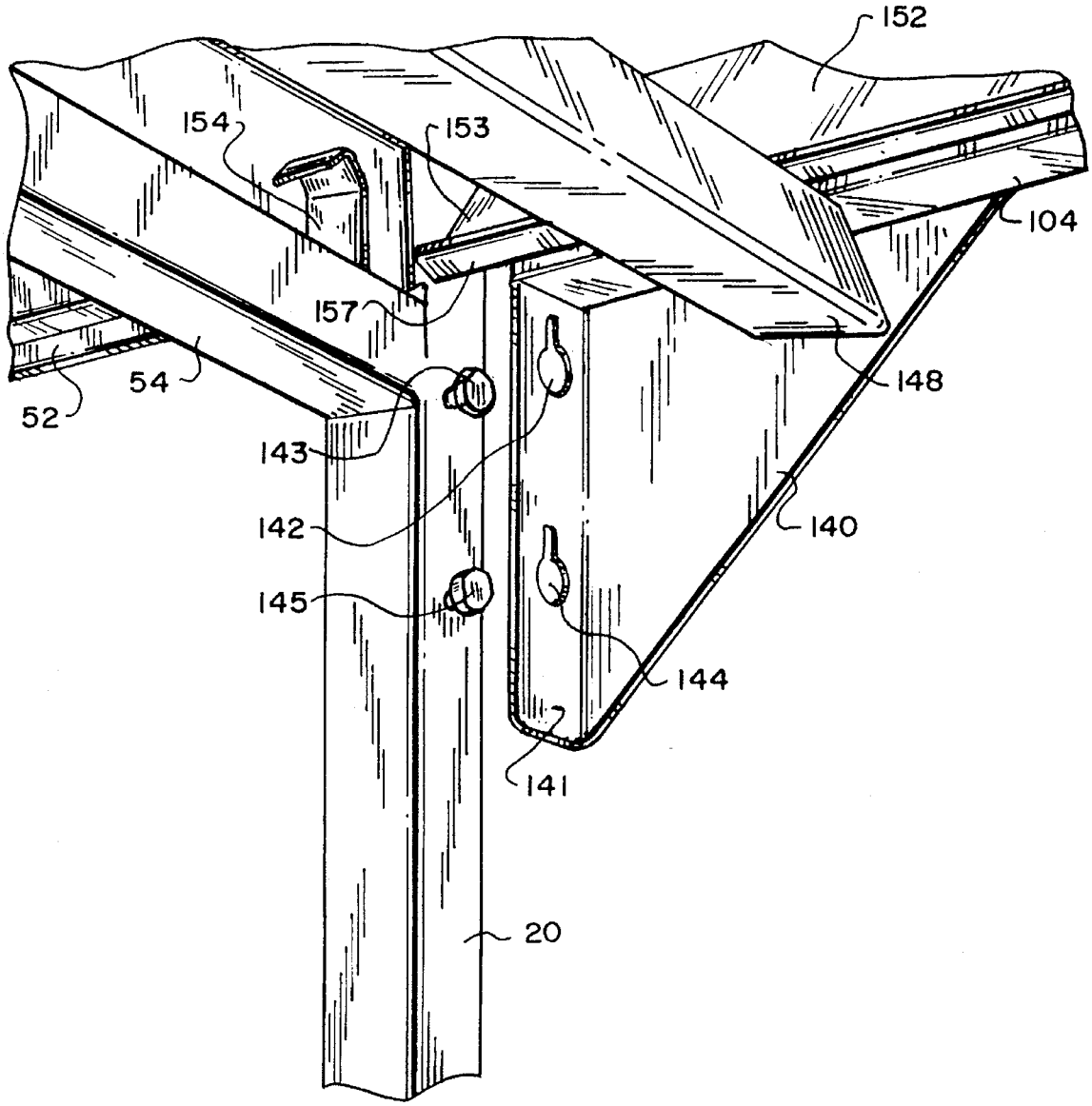
FIG. 5A is a more detailed view of the preferred means of the apparatus of FIG. 1 of removably attaching the outrigger to the chair.
Figure 5B:
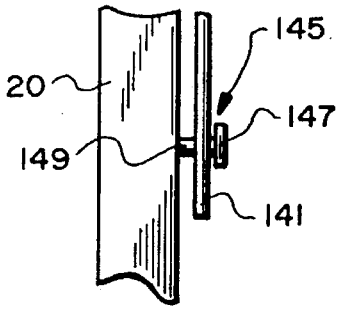
FIG. 5B is a side view of the outrigger of FIG. 5A engaged with the chair.
Figure 6:
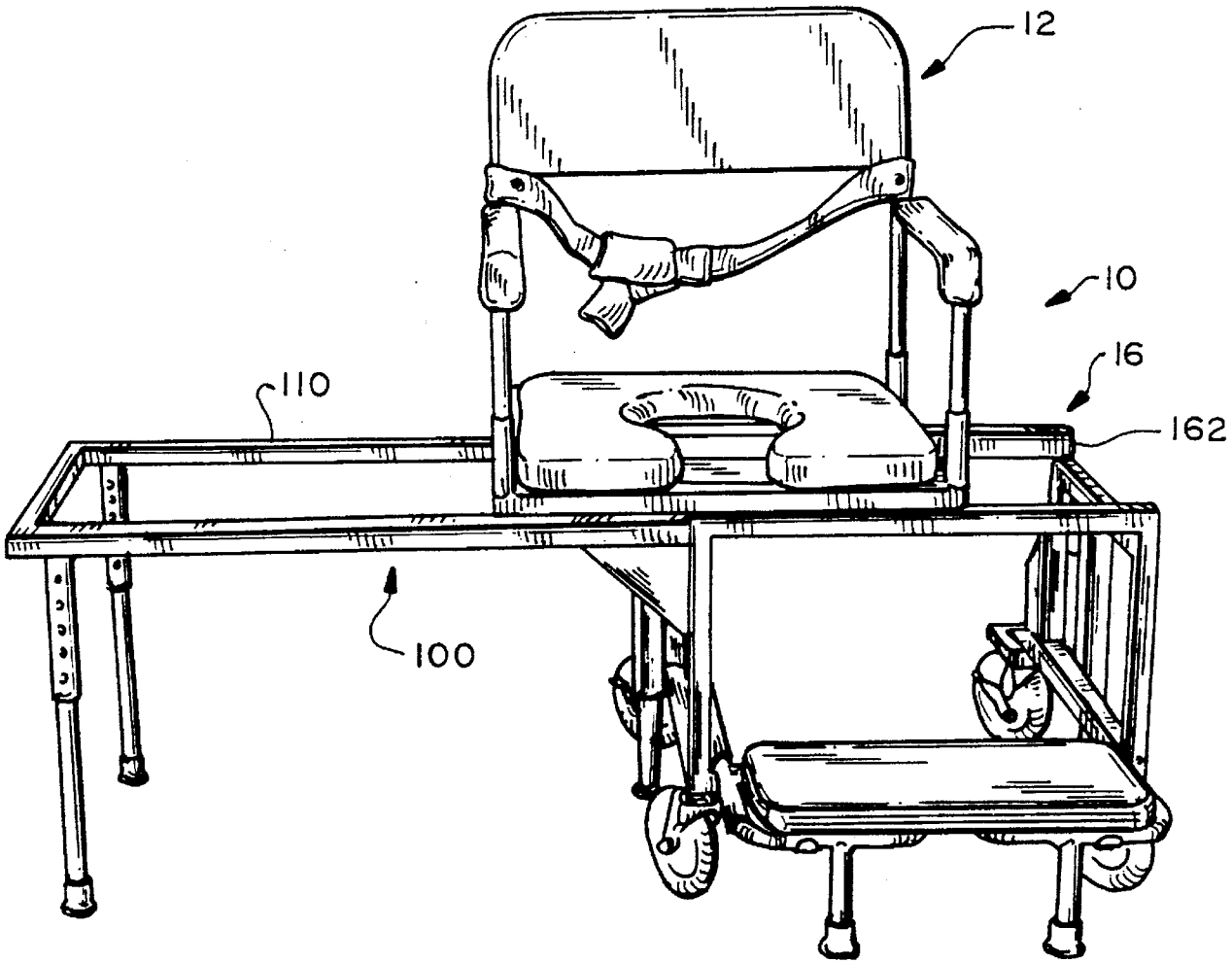
FIG. 6 is a view similar to that of FIG. 1 but with the chair partially slid onto the outrigger.

Outrigger section 100 is removably attachable to base section 16 as shown in FIG. 5A and described below. Outrigger section 100 includes parallel side support members 102 and 104 interconnected at one end by cross member 111 and at the other end by cross member 148, FIG. 3A. Track members 110 and 152 are carried on the inside of support members 102 and 104, respectively. Track members 110 and 152 are the same C-shaped track as track member 154 and 162 of base section 16. This arrangement allows the wheels of seat section 12 to be slid from base section 16 onto and along outrigger section 100 from the commode chair position shown in FIG. 1, to the intermediate position shown in FIG. 6, to the end most position shown in FIG. 7, in which the seat section may be used to support a person over a standard tub.

Outrigger section 100 includes leg members 106 and 108 which are made adjustable in length by including a series of holes therein, and holes in the upper receiving tubes, in a standard fashion. Legs 106 and 108 have rubber feet 107 and 109 which can rest on the floor of the tub.

Figure 7:
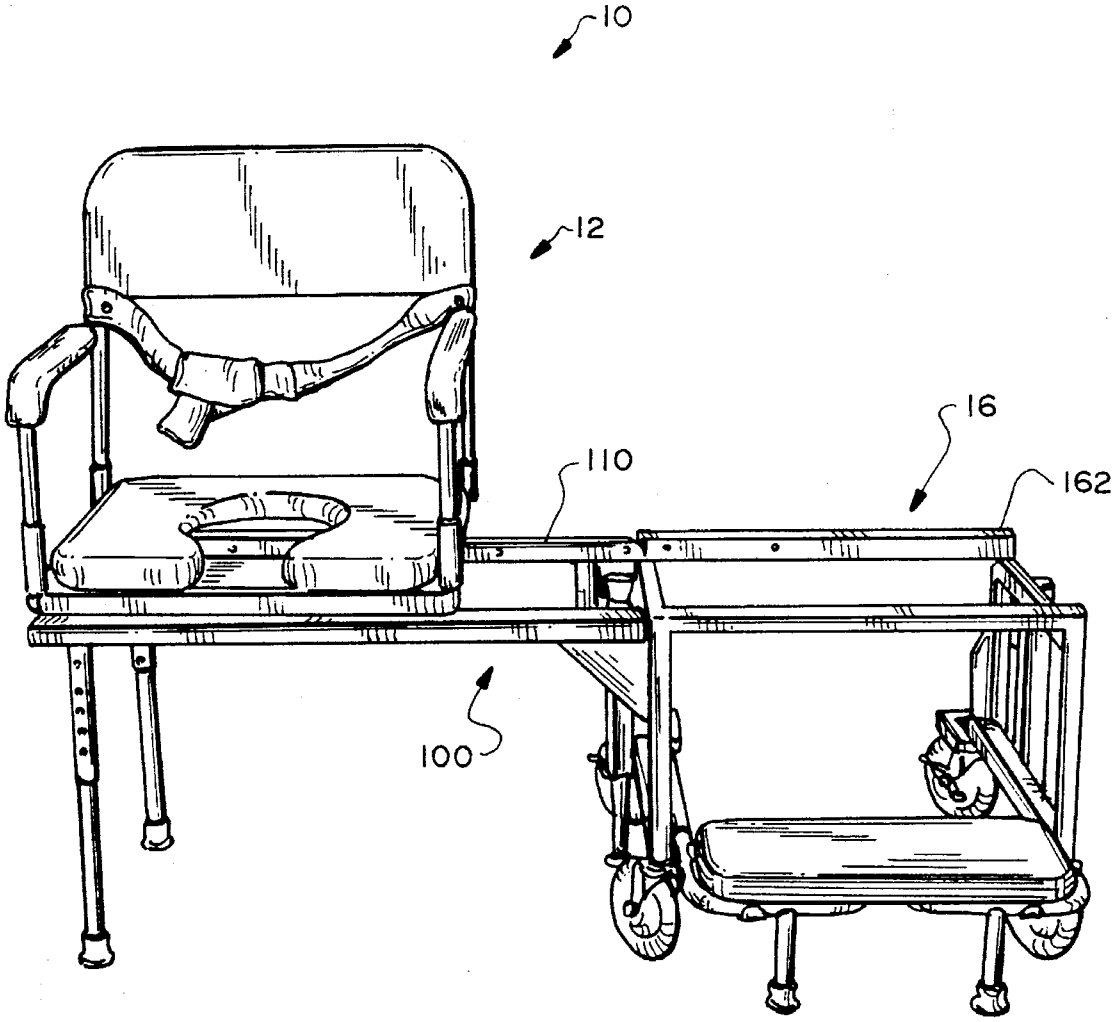
FIG. 7 is a similar view with the chair slid all the way over to the end of the outrigger, the position in which the person would be when using the bathtub facilities.

The outrigger section is used as follows, with details of the attachment of the outrigger to the base section shown in FIG. 5A. When the person desires to take a shower, the base section and seat section as shown in FIG. 2 is wheeled up against the side of a standard bathtub. Outrigger section 100 is then attached to base section 16, with feet 107 and 109 resting in the tub bottom. Legs 106 and 108 are adjusted so that side support members 102 and 104 are essentially horizontal. Pin 112 is then removed and seat section 12 can be easily slid along outrigger section 10 to the end as shown in FIG. 7. This places the person over the tub or within the tub area so that he or she can operate the shower.

In the preferred embodiment, the outrigger section is made removably attachable to the base section as follows. Outrigger section 100 has two plates, one plate, numbered 140, shown in FIG. 5A. The other side of the outrigger section has an identical arrangement. Plate 140 carries end plate 141 which includes key ways 142 and 144. Base section 16 carries enlarged head-studs 143 and 145 which are adapted to be received within key ways 142 and 144, respectively. When plate 141 is engaged with studs 143 and 145, and the two other studs on the other side of the outrigger section, not shown in the drawings, support the weight of the outrigger section. See FIG. 5B. Track member 152 carried on the inside of side support member 104 has lower lip 157 which rests on, or is close to, the top of base section upper cross member 54. End 153 of track member 152 is angle cut as shown so that the outrigger section can be lifted slightly higher than its resting position to allow studs 143 and 145 to fit in key ways 142 and 144. Then, when the outrigger section is dropped to its rest position, track 152 is properly aligned with track member 154 carried on upper front cross member 52 of base section 16. The end result is that there is one almost contiguous track which the four wheels of base section 16 can slide along. The open sides of the C-shaped track portions on the base section and the outrigger section face one another.

Figure 8:
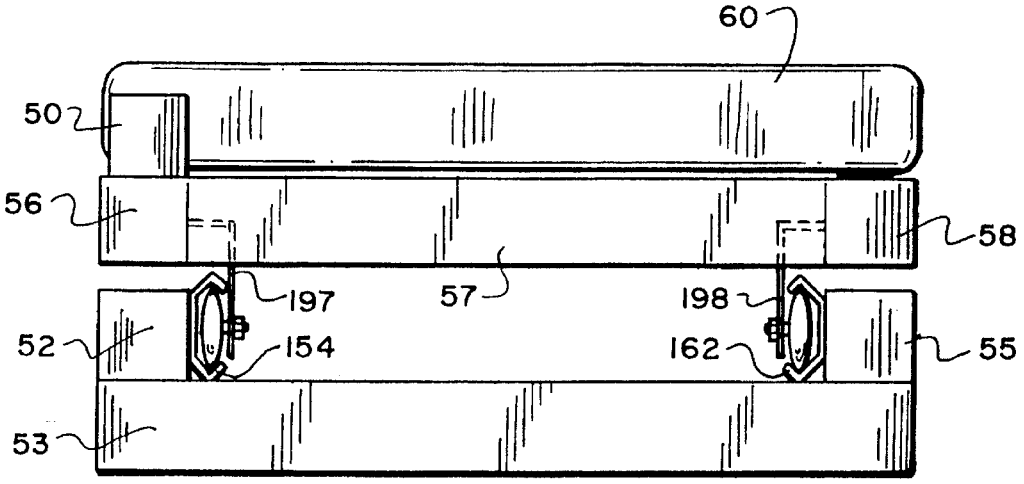
FIG. 8 is an enlarged schematic end view of the tracks, and the wheels of the seat section which engage the tracks, of the apparatus shown in the preceding drawings, which allows the seat to be slid onto and off of the outrigger.
Figure 9A:
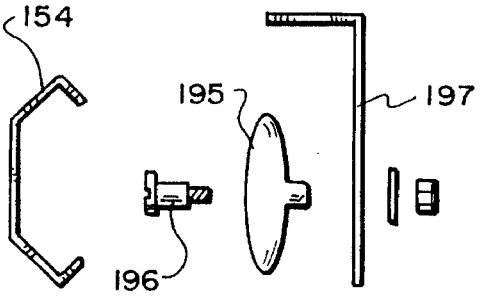
FIGS. 9A and 9B are exploded views of the manner in which the wheels are attached to the seat section.
Figure 9B:
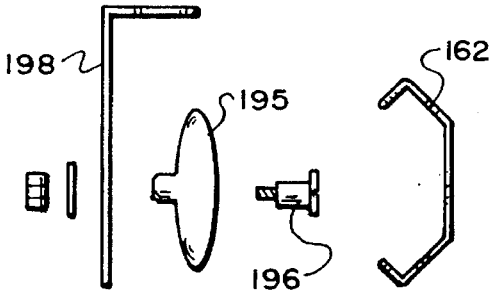

Seat section 12 includes padded toilet seat 60 which is attached to a frame consisting of four horizontal seat base support members 56 through 59, connected in a rectangular pattern, which rest on the base section 16. Front and rear seat base support members 56 and 58 have flat members 197 and 198 attached to their full length and extending below the seat base support members, FIGS. 8, 9A, 9B. Flat members 197 and 198 have attached thereto no less than two wheels 195 each, these four wheels support seat section 12 at all times. Wheel members 195 are attached to a flat member by a nut, washer and bolt assembly 196. The bolt is designed so that when the nut is tightened, wheel member 195 will turn freely.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A combined commode and shower chair apparatus, comprising:

a base section supported on wheels and including parallel roller-receiving track members along its upper portion;

a seat section adapted to rest on and movably supported on said base section, and including a seat, at least one side arm rest, and a back member, all connected together so that they move as a unit; and lower rollers adapted to roll along said roller-receiving track members of said base section, to allow said seat section to move relative to said base section;

an outrigger section including two parallel side support members interconnected proximate their distal ends with a cross member; adjustable-height legs attached proximate said distal ends of said parallel side support members; and a roller-receiving track member carried by and substantially along the length of each said two parallel side support members, to allow said seat section to roll along said outrigger section;

a pair of two-part, mating, releasable outrigger section-base section engagement mechanisms, one part of each pair on each said side support member at the other of their ends, and the second part of each pair on said base section, said pair of engagement mechanisms including a plurality of slotted key ways on one of said base section and said outrigger section, and a like plurality of enlarged-head studs on the other of said base section and said outrigger section for fitting into and engaging with said key ways, said two parts of each said engagement mechanism adapted to releasably engage with each other to removably attach said outrigger section against said base section such that said track members on said outrigger section and said track members on said base section align, to allow said rollers of said seat section to roll along said track members for moving said seat section, including said seat, said at least one arm rest, and said back member, to and from said base section and said outrigger section.

2. The commode and shower chair of claim 1 in which said base section includes four spaced vertical base support members.

3. The commode and shower chair of claim 2 in which said base section further includes a wheel coupled to each said vertical base support member for allowing said base section to be wheeled about.

4. The commode and shower chair of claim 3 further including two floor friction brakes for contacting the ground to lift at least two said base section wheels off of the ground to stabilize said base section.

5. The commode and shower chair of claim 2 in which said base section further includes four upper cross-members interconnecting said vertical base support members proximate the upper ends thereof in a rectangular pattern.

6. The commode and shower chair of claim 5 in which said base section further includes two lower cross-members, each one interconnecting two different vertical base support members to leave the lower portion of at least one side of said base section open so that it can fit over a commode.

7. The commode and shower chair of claim 1 in which said seat section includes two rollers on each of two sides engaged with said track members.

8. The commode and shower chair of claim 1 in which said at least one side arm rest is pivotably attached to said seat section to permit entry and exit from the seat from the side of the seat.

9. The commode and shower chair of claim 1 in which said track members include a C-shaped track mounted to opposite sides of said base section such that the open parts of the tracks face one another, and the same shaped track mounted along each parallel side support member of said outrigger section such that their open parts face one another, wherein each track on said base section is aligned with a track on said outrigger section when said outrigger section is attached to said base section to allow said seat section to roll on said rollers along the track from said base section onto said outrigger section.

10. A combined commode and shower chair apparatus, comprising:

a base section including four leg members with wheels at one end; upper cross-members interconnecting said leg members in a rectangular pattern; and lower cross members interconnecting no more than three said leg members to leave an opening so that said base section can be wheeled over a commode;

wheel-receiving track members on the inside and substantially along the length of two parallel upper cross members;

a seat section including four seat support members interconnected in a rectangular pattern; a padded seat on top of said four seat support members; at least one side arm rest and a back member, connected to said four seat support members; and at least two wheels on axles fixed to each of two parallel seat support members, said wheels adapted to fit into said wheel-receiving track members on the inside and along the length of said two parallel upper cross members;

an outrigger section including two parallel side support members interconnected at one end with a cross member; adjustable-height legs attached proximate said one ends of said parallel side support members; and wheel-receiving track members on the inside and substantially along the length of said two parallel side support members; and a plurality of slotted key ways on one of said outrigger section proximate the other ends of its parallel side support members, and said base section; and a like plurality of enlarged-head studs on the other of said outrigger section proximate the other ends of its parallel side support members, and said base section, said studs fitting into said key ways to hold said outrigger section against said base section such that the track members on said outrigger section and said base section align to allow the wheels of said seat section to roll along the track for moving said seat section to and from said base section and said outrigger section.

* * * * *